US006287193B1

(12) United States Patent
Rehkemper et al.

(10) Patent No.: US 6,287,193 B1
(45) Date of Patent: Sep. 11, 2001

(54) HAND-HELD GAME WITH VISUAL DISPLAY AND FEEDBACK

(76) Inventors: Steven F. Rehkemper, 1030 N. State St.; Jeffrey G. Rehkemper, 329 W. Evergreen Ave., both of Chicago, IL (US) 60610; Dennis J. O'Patka, 5231 N. Leamington Ave., Chicago, IL (US) 60613; Ronald L. Black, 525 S. Lyman Ave., Oak Park, IL (US) 60304; Michael M. Kass, 4952 N. Hamlin Ave., Chicago, IL (US) 60625

( * ) Notice: Subject to any disclaimer, the term of this patent is extended or adjusted under 35 U.S.C. 154(b) by 0 days.

(21) Appl. No.: 09/241,318

(22) Filed: Feb. 2, 1999

(51) Int. Cl.[7] ..... A63F 13/00

(52) U.S. Cl. ..... 463/1; 273/142 R; 273/142 H; 446/242; 446/244; 446/256

(58) Field of Search ..... 463/15, 30, 31, 463/32, 33, 36–39; 362/252; 273/142 R, 143 R, 141 R, 142 H, 147, 138.2; 446/236, 237, 238, 239, 256, 257, 260, 240, 242, 243, 245

(56) References Cited

U.S. PATENT DOCUMENTS

| | | | |
|---|---|---|---|
| 3,162,979 | 12/1964 | Garoogian | 446/242 |
| 3,924,114 | 12/1975 | Sanchez | 240/6.4 R |
| 4,327,518 | 5/1982 | Knauff | 46/228 |
| 4,775,948 | 10/1988 | Dial et al. | 364/565 |
| 4,820,979 | 4/1989 | Schwerdhöfer et al. | 324/171 |
| 4,867,727 | 9/1989 | Lanius | 446/242 |
| 4,875,675 | 10/1989 | Arad et al. | 272/74 |
| 5,145,444 | 9/1992 | VanKuiken | 446/242 |
| 5,356,328 | 10/1994 | Ho | 446/242 |
| 5,446,775 | 8/1995 | Wright et al. | 377/24.2 |
| 5,791,966 | 8/1998 | Capps et al. | 446/242 |
| 6,077,145 * | 1/1999 | Ma | 446/250 |
| 6,083,076 * | 7/2000 | Sainr-Victor | 446/242 |

* cited by examiner

*Primary Examiner*—Michael O'Neill
*Assistant Examiner*—Sheila Clayton

(57) ABSTRACT

This invention relates generally to electronic and electromechanical games having a visual display in which the user can obtain feedback on his or her performance during, or after, play, play a game stored in memory, and/or interact with a virtual pet or other character and, more particularly, to a hand-held game apparatus comprising a rotatable body rotating about an axis of rotation incorporating a display coupled to the apparatus for displaying graphics and textual images, a controller coupled to the apparatus for receiving, processing, and outputting data, graphics, and textual images to the display, memory coupled to, and accessible by, the controller for storing information relating to the electronic game, a sensor coupled to the controller for receiving information related to the use of the electronic game and for transmitting the information to the controller, and one or more user inputs for inputting commands to the electronic game.

21 Claims, 5 Drawing Sheets

HAND-HELD GAME WITH VISUAL DISPLAY AND FEEDBACK

RESERVATION OF COPYRIGHT

A portion of the disclosure of this patent document contains material which is subject to copyright protection. The copyright owner has no objection to the facsimile reproduction by anyone of the patent document or the patent disclosure, as it appears in the Patent and Trademark Office patent file or records, as it becomes available to the public, but otherwise reserves all copyright rights whatsoever.

BACKGROUND OF THE INVENTION

1. Field of the Invention

This invention relates generally to electronic and electromechanical games and, more particularly, to hand-held games having a visual display in which the user can obtain feedback on his or her performance during, or after, play, play a game, and/or interact with a virtual pet or other character.

2. Description of the Related Art

Mechanical games (games in which the user performs the entire game via some mechanical function without the assistance of electronics), have decreased in popularity over the years. With the advent of electronics, many of these games have become obsolete, and others merely remain in existence for nostalgic purposes. In order to curb this trend, some people have tried to rekindle consumer interest in such games by adding electronics to them. While such attempts have added electronics, none have achieved the level of inviting user interaction and/or providing user feedback.

For example, U.S. Pat. No. 4,327,518, to Knauff, discloses an inertial device for adding sight and/or sound to a rotating device, be it a wheel, a yo-yo, a top, a frisbee, or any other like device. While Knauff discloses adding electronics to a rotating device, it is limited in the type of entertainment it provides because it does not invite user interaction and/or provide the user with feedback on his or her performance during, or after, the game. Ultimately, the addition of such electronics amounts to no more than adding "bells and whistles" to an old mechanical game. Such attempts are doomed to fail in attracting and maintaining the user's attention. After minutes, if not seconds, of play, any user will realize that this is simply the same old mechanical game with an added "blinking light" or "cute noise." The addition of such electronics neither allows for user interaction nor provides the user with feedback on his or her performance during, or after, the game.

Another attempt to modernize mechanical games is disclosed in U.S. Pat. No. 5,145,444, to VanKuiken. VanKuiken discloses use of a light emitting diode (LED), positioned within a rotatable device, such as a yo-yo, to produce "a stroboscopic effect." The addition of LEDs to a rotatable device does, perhaps, make the device more interesting to look at, but will quickly lose the observer's interest because it too does not allow for user interaction and/or provide the user with feedback during, or after, the game.

Similarly, U.S. Pat. No. 5,356,328, to Ho, discloses a multi-purpose yo-yo that provides for a plurality of LEDs, which light-up upon rotation of the yo-yo, and a speaker to generate "funny" or "exciting" sounds. Again, the addition of LEDs and/or speakers create initial interest in the operation of the device, but quickly lose their attraction because they fail to create user interaction and/or supply the user with feedback on his or her performance during, or after, the game.

Lastly, U.S. Pat. No. 5,791,966, to Capps et al., discloses a rotating body having an electronic display. This patent discloses use of a display to generate a message that can be read by a user once the rotational speed of the body is in synchronization with the clocking speed of the display circuitry. The Capps patent discloses nothing more than an invention capable of displaying a visual message or character. Such a device is limited in that it only provides a preselected output to be displayed to the user and does not provide user interaction and/or feedback on the user's performance during, or after, the game.

Accordingly, it has been determined that the need exists for an improved electronic toy which overcomes the aforementioned limitations and which further provides capabilities, features and functions, not available in current devices (be they simply mechanical, electrical, or electromechanical).

SUMMARY OF THE INVENTION

A hand-held electronic game apparatus according to the present invention provides added functionality and enjoyment by enabling the user to interact with a plurality of game functions. The plurality of game functions include such things as: allowing the user to obtain feedback on his or her performance during, or after, the game; allowing user interaction with a virtual pet or character of some kind; allowing the user to play additional games stored in memory (e.g., video games); and/or allowing the user to turn on and off, or reset, the game.

The feedback function of the game includes the ability to obtain information such as: the distance the device has traveled, the speed at which the device moved, the amount of time the device has, or has not, been used, and the number of times the device has been used or operated. Allowing the user to obtain feedback on the distance the device has traveled can be accomplished in several different manners. The cumulative distance traveled could be displayed to the user (much like an odometer reading). In addition, feedback on distance traveled could be displayed as the distance of each yo (one yo is equal to a release and catch of a yo-yo), or each toss (a toss of any device be it a top, frisbee, or any other rotational body). Furthermore, the distance traveled could be displayed as the distance the device has traveled for that specific period of use. Typically, such measurements are displayed in miles or kilometers, but could be displayed in any unit for measuring distance including fictitious measuring units (i.e., yo-miles, yo-kilometers, etc.).

The speed at which the device moves could be displayed to the user in many different manners as well. Such a measurement could be displayed as the maximum speed the device has reached over its lifetime. Another way of displaying the speed is by providing the user with the average speed reached over its lifetime. In addition, the speed of the device could be displayed as the speed reached each yo, or toss. Further, the speed of the device may be displayed as the speed reached each period of use, or average speed reached each period of use. Such measurements are typically displayed in miles-per-hour (mph), kilometers-per-hour (kph), or revolutions-per-minute (rpm). However, any unit for measuring speed or velocity could be used, including fictitious measuring units (i.e., rpyo, rpuse, etc.).

Allowing the user to obtain feedback on the amount of time the device has, or has not, been used may also be a valuable piece of information. This amount of time could be displayed as the amount of time the device has been used over its lifetime. Similarly, this could be displayed as the amount of time the device has not been used over its lifetime (its "sleep" time). The amount of time the device has been used could also be displayed as the amount of time of each period of use or the amount of sleep time between each period of use. The average of these periods could be displayed as well. Amounts of time are usually displayed in seconds, minutes, hours, days, or years, but could be displayed in any measuring unit of time, including fictitious units.

The user may also desire feedback in the form of a count. Such a measurement may display the number of times the rotational body has been used. Another counting measurement may be displayed as the number of yos, or tosses, over the rotational bodies lifetime. In addition, the user may desire a counting of the number of yos, or tosses, each period of use, or the average number of yos, or tosses, each period of use.

Regardless of the information, or manner in which it is displayed, the user will appreciate the ability to obtain feedback from this device.

An additional game function might consist of the ability to care for a virtual pet, or other character. During play with a yo-yo or top, for example, the user could interact with a virtual pet such as a dog, cat, monkey, alien, robot, or dinosaur. The user may also interact with other characters such as a person, clown, or fictitious creature. Likewise, the user may interact with multiple virtual pets, characters, or a combination thereof.

This interaction, may include the ability to name and care for the characteristics of the pet or character. Such characteristics may include happiness, health, hygiene, life, and feeding or play schedule. For instance, the act of playing the game may be required to feed the pet/character or keep it alive. When a particular pet or character dies, the game may store its name and properties. In addition, numerous play activities may be provided with the game. For example, the user may be able to play catch with a ball, catch a frisbee, or pull on a toy. Similarly, the user may be required to "walk the dog" for a specified amount of time in order to satisfy the pet/character's craving for play. When the user interacts with the pet or character, he or she can earn points for happiness of the pet/character or points for training the pet or character a particular trick. For instance, the user could earn points or increase the health of a pet/character simply by playing the game (i.e., tossing the yo-yo, or turning the top).

Another game function might consist of the ability to play additional games stored in memory. After playing the game in a mechanical way (i.e., yo-yoing, spinning the top, etc.), the user may opt to play a different electronic game offered by the same device (i.e. a video game stored in memory).

Further game functions of the hand-held electronic game allow the user to turn on and off the game and/or reset the game.

BRIEF DESCRIPTION OF THE DRAWINGS

Other objects and advantages of the invention will become apparent upon reading the following detailed description, upon examining the exemplary software code provided in Appendix A, and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENTS

Figure 1:
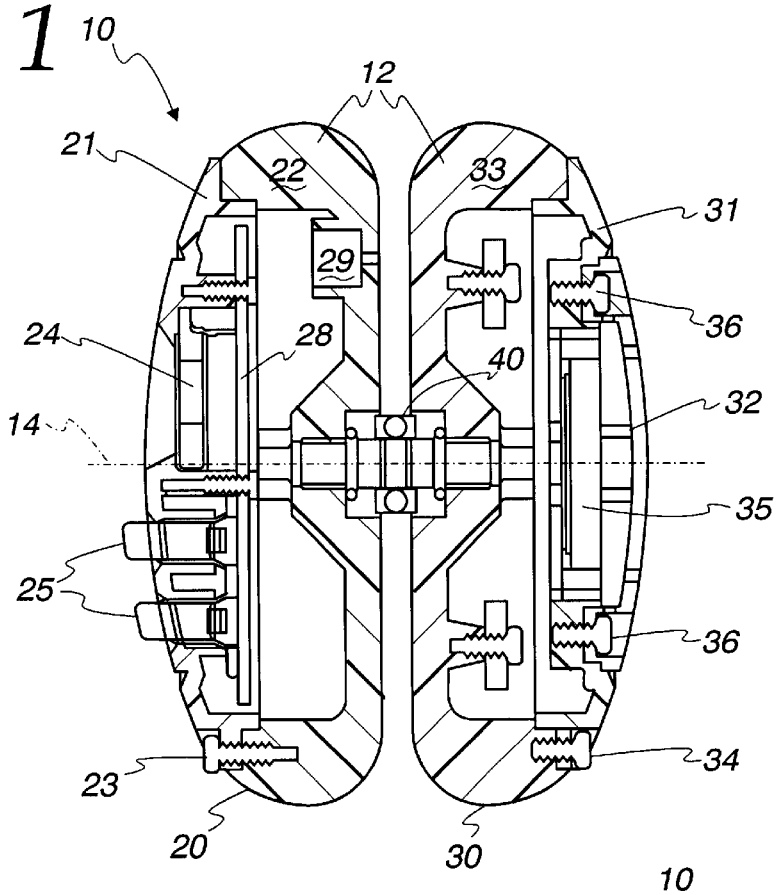
FIG. 1 is a cutaway view of a hand-held electronic game apparatus according to the invention.

Referring to FIG. 1, a hand-held electronic game according to the invention is shown generally at reference numeral 10. In the preferred embodiment, the game 10 consists of a body 12 capable of rotating about an axis of rotation 14. The body 12 is made up of a left portion 20, a right portion 30, and a shaft 40 connecting the two portions. The left portion 20 contains a face plate 21 and a shell 22. The face plate 21 is connected to the shell 22 by a fastener, or fasteners, 23. The fastener, or fasteners, 23 are preferably screws or bolts capable of releasably attaching the face plate 21 to the shell 22, but other fasteners may be used including those that fixedly attach the face plate 21 to the shell 22 (i.e., rivets or glue). The face plate 22 incorporates locations for a display or screen 24, one or more user inputs 25, a controller 26 (not shown), and memory 27 (not shown). The display 24 is preferably a liquid-crystal display (LCD), but other displays may be used, such as dot matrix. The controller 26 is preferably an integrated circuit chip (IC), but may be discrete logic and ancillary electronic components. The one or more inputs 25 preferably are push buttons protruding from the surface of the face plate 21, but other types of inputs may be used, such as touch pads or inputs not protruding from the face plate 21. In the preferred embodiment, the display 24, one or more inputs 25, controller 26 (not shown), and memory 27 (not shown) are connected to a circuit board 28 located in the left portion 20 of the body 12. However, in an alternative embodiment, any or all of these components could be located in a similar manner in the right portion 30 of the body 12. The shell 22 incorporates a location for a sensor 29. The sensor 29 is preferably an optical sensor capable of detecting changes in light, but other sensors may be used such as centrifugal sensors. In the preferred embodiment, the sensor 29 detects a change in light every time the string (not shown) attached to the shaft 40 crosses the sensor 29. In an alternate embodiment, the face plate 21 and shell 22 may be the same piece (i.e., the left portion 20 might have no face plate and shell distinction).

The right portion 30 contains a rear plate 31, a battery cover 32, and a shell 33. The rear plate 31 is connected to the shell 33 by a fastener, or fasteners, 34. The fastener, or fasteners, 34 are preferably screws or bolts capable of releasably attaching the rear plate 31 to the shell 33, but other fasteners may be used including those that fixedly attach the rear plate 31 to the shell 33 (i.e., rivets or glue). The rear plate 31 incorporates locations for a battery compartment 35. The battery compartment is enclosed by the battery cover 32. The battery cover 32 is connected to the rear plate 31 by a fastener, or fasteners, 36. The fastener, or fasteners, 36 are preferably screws or bolts capable of releasably attaching the battery cover 32 to the rear plate 31, but other fasteners may be used including those that fixedly attach the battery cover 32 to the rear plate 31 (i.e., rivets or glue). In an alternative embodiment, the rear plate 31 and battery cover 32 may be the same piece, requiring the removal of that one piece if the batteries were to be changed. In the preferred embodiment, the body 12 rotates up and down a string (not shown) attached to said shaft 40. In alternate embodiments, said string (not shown) could be any synthetic or fibrous material capable of coiling around said shaft 40.

Figure 2:
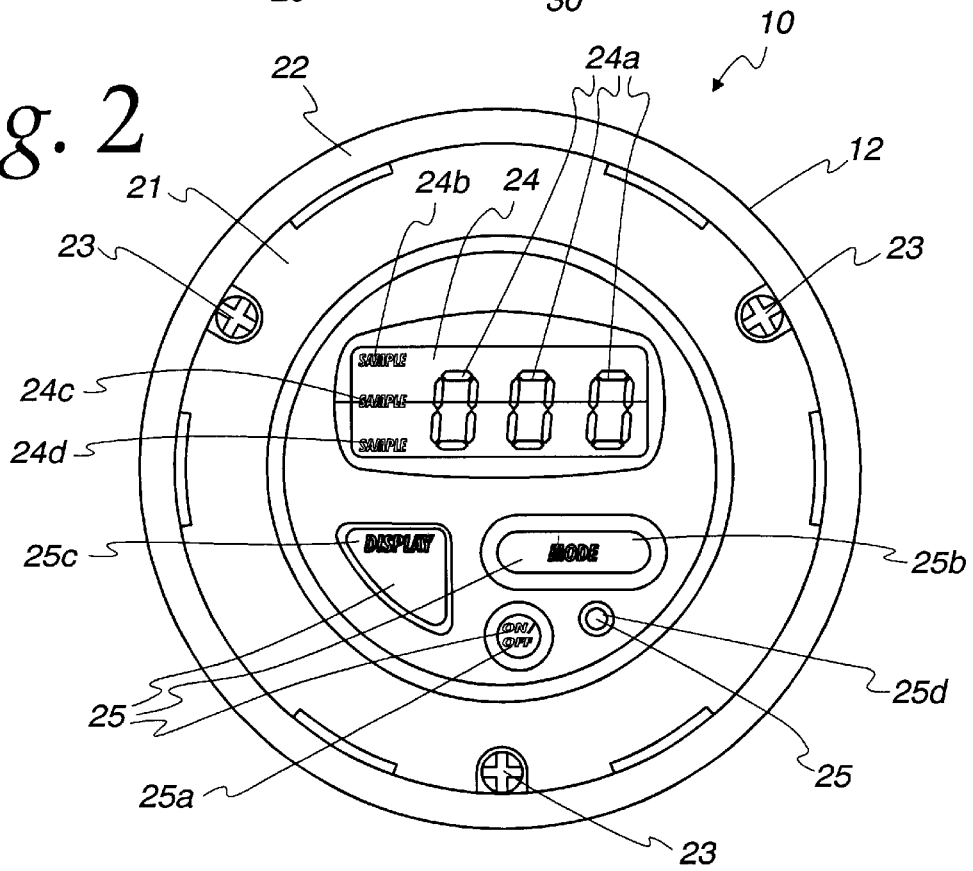
FIG. 2 is a front view of the hand-held electronic game apparatus shown in FIG. 1.

Referring now to FIG. 2, there is shown a front view of the hand-held electronic game 10 (an elevation view of the left portion 20). The body 12 of the hand-held electronic game 10 consists of the face plate 21 and the shell 22. The face plate 21 is connected to the shell 22 by a fastener, or fasteners 23. The fastener, or fasteners, 23 are preferably screws or bolts capable of releasably attaching the face plate 21 to the shell 22, but other fasteners may be used including those that fixedly attach the face plate 21 to the shell 22 (i.e., rivets or glue). The face plate 21 incorporates the display 24 and a plurality of user inputs 25. In an alternative embodiment, the user input might consist of one or more user inputs. The LCD display 24 shows an exemplary character display 24*a* and exemplary feedback symbols 24*b–d*. The user inputs 25 include an on/off button (power button) 25*a*, a mode button (or select button) 25*b*, a display button 25*c*, and a reset button 25*d*. When the power button 25*a* is depressed, the game 10 is either turned on or off. Mode button 25*b* is depressed to select what game function the user would like to access (e.g., distance, speed, time, count, game and/or virtual pet characteristics). In the preferred embodiment, the user must depress the mode button 25*b* to select what type of feedback he or she would like to obtain before playing with the game 10. However, an alternative embodiment could be to allow the user to play the game and then select what type of feedback he or she would like to obtain, or even view various types of feedback after each period of use. A further alternative embodiment would be to require no such selection and merely display all game functions on the display 24 at all times, or automatically have the display 24 scroll through each game function.

By depressing the mode button 25*b*, the user can obtain feedback on the distance the rotational body traveled, the speed at which the rotational body moved, the amount of time the rotational body has, or has not, been used, and the number of times the device has been used or operated. Allowing the user to obtain feedback on the distance the rotational body has traveled can be accomplished in several different manners. In the preferred embodiment, the distance traveled will be displayed to the user as the distance the rotational body has traveled for that specific period of use. In alternative embodiments, the distance the rotational body has traveled could be displayed as the distance of each yo (one yo is equal to a release and catch of a yo-yo), or each toss (a toss of any rotational body be it a top, disk, etc.). Furthermore, the distance the rotational body has traveled could be displayed as the cumulative distance traveled over the lifetime of the game (much like an odometer reading). Typically, such a measurement is displayed in miles or kilometers, but could be displayed in any unit for measuring distance including fictitious measuring units (i.e., yo-miles, yo-kilometers, etc.). The LCD display 24 shows an exemplary feedback display of "DISTANCE" 24*b*.

The speed at which the rotational body moves could be displayed to the user in many different manners as well. In the preferred embodiment, the speed will be displayed as the average speed at which the body 12 has spun. In alternative embodiments, speed may be displayed as the maximum speed the rotational body has reached over its lifetime. Another way of displaying the speed at which the rotational body moves is by providing the user with the average speed reached over its lifetime. In addition, the speed of the rotational body could be displayed as the speed reached each yo, or toss. Further, the speed of the rotational body may be displayed as the speed reached during each period of use, or average speed reached each period of use. Such measurements are typically displayed in miles-per-hour (mph), kilometers-per-hour (kph), or revolutions-per-minute (rpm). However, any unit for measuring speed or velocity could be used, including fictitious measuring units (i.e., rpyo, rpuse, etc.). The LCD display 24 shows an exemplary feedback display of "RPM" 24*d*.

Allowing the user to obtain feedback on the amount of time the rotational body has, or has not, been used may be an additional feedback option. This amount of time could be displayed as the amount of time the rotational body has been used over its lifetime. However, in the preferred embodiment, this will be displayed as the amount of time the rotational body has not been used over its lifetime (its "sleep" time). The amount of time the rotational body has been used could also be displayed as the amount of time of each period of use or the amount of sleep time between each period of use. The average of these periods could be displayed as well. Amounts of time are usually displayed in seconds, minutes, hours, days, or years, but could be displayed in any measuring unit of time, including fictitious units.

The user may also desire feedback in the form of a count. Such a measurement may display the number of times the rotational body has been used. Another counting measurement may be displayed as the number of yos, or tosses, over the rotational bodies lifetime. In the preferred embodiment, the count is displayed as the number of yos, or tosses, each period of use (i.e., it starts a new count every time the game is turned on and off). In alternative embodiments, the count may be displayed as the average number of yos, or tosses, each period of use.

According to the preferred embodiment, the user will be able to view the display 24 by depressing the display button 25*c*. If the speed mode was selected by depressing the mode button 25*b* prior to using the game 10, the average speed at which the body 12 has spun will be displayed once the display button 25*c* has been depressed. In an alternative embodiment, there may be no display button because the feedback selected will continually be visible on the display 24. In another embodiment, the feedback selected may automatically be displayed once the body 12 has stopped moving.

An additional game function elected by depressing the mode button 25*b* might consist of the ability to care for, and receive feedback on the characteristics of, a virtual pet, or other character. During or after play with a yo-yo or top, for example, the user could interact with a virtual pet such as a dog, cat, monkey, alien, robot, dinosaur, or interact with other characters such as a person, clown, or fictitious creature. Moreover, the user may interact with multiple virtual pets, characters, or a combination thereof.

Interaction of this type may include the ability to name and care for the characteristics of the pet or character. Such characteristics may include happiness, health, hygiene, life, and feeding or play schedule. For instance, the act of playing the game may require the user to feed the pet/character to keep it alive. When a particular pet or character dies, the game may store its name and properties. In addition, numerous play activities may be provided with the game. For example, the user may be able to play catch with a ball, catch a disk, or pull on a toy. Similarly, the user may be required to perform specified tricks (i.e., walk the dog, around the world, etc.), in order to satisfy the pet/character's craving for play or to score higher. When the user interacts with the pet or character, he or she can earn points for happiness of the pet or character or points for training the pet or character a particular trick. For instance, the user could earn points or increase the health of a pet/character simply by playing the game (i.e., tossing the yo-yo, or turning the top).

A further game function elected by depressing the mode button 25*b* might consist of the ability to play additional games from memory (e.g., video games). After playing the game in a mechanical way (i.e., yo-yoing, spinning the top, etc.), the user may opt to play a different electronic game offered by the same device (i.e. a video game stored in memory). Such a game could be a role-playing game where the user operates the user input 25 to control a character. One input may be used to control direction (e.g., up, down, left, right, etc.), another may be used to control action (e.g., punch, kick, use weapon, etc.). Additional games include action games where the user fights or attacks a specified enemy or target. One input may be used to aim and another may be used to fire, punch, kick, etc.

An additional function of the game 10 found in the preferred embodiment is the reset button 25*d*. The reset button allows the user to clear/reset the display. In an alternative embodiment, the reset button may reset all data stored in the memory 27 of the game. In an additional embodiment, no reset button may be present because there is no reset feature or the game can be reset in an alternative method.

Figure 3:
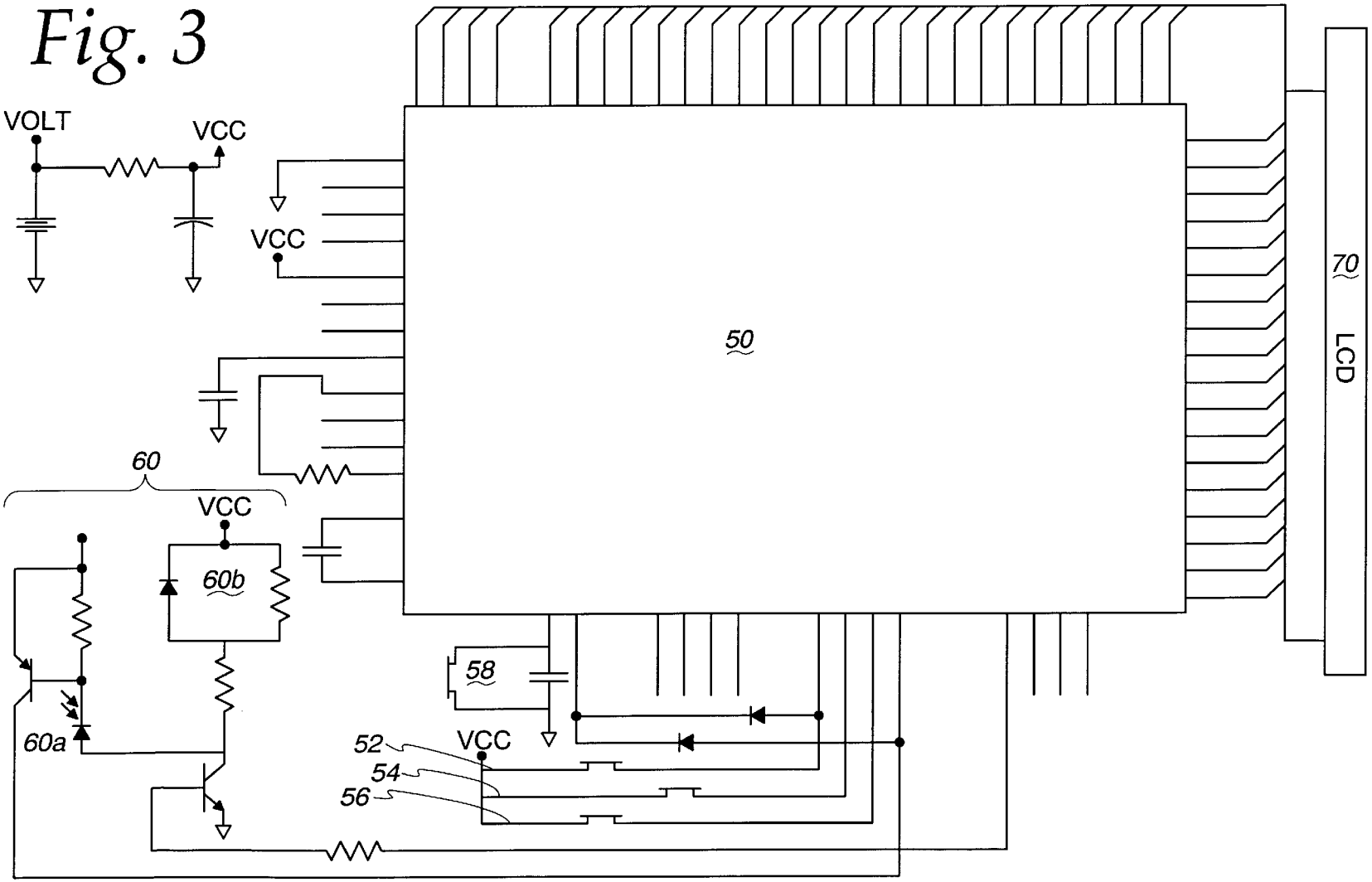
FIG. 3 is a schematic of the circuitry for a hand-held electronic game apparatus according to the invention.

FIG. 3 is a schematic diagram of the electronic circuitry of a hand-held electronic game according to the invention. In this embodiment, the hand-held electronic game utilizes an integrated circuit chip (IC) 50 to perform many operations, but it should be apparent to those skilled in the art that other ICs could be used, and that none of these operations require use of an IC. The IC 50 controls the operation of various components of the electronic game 10. The on/off input 52 turns on/off the game. The mode input 54 allows the user to chose what game function he or she would like to access. The display input 56 allows the user to view the selected game function on the display (LCD) 70. The reset input 58 resets the operation of the game, effectively clearing all data accumulated and displayed. When the game is turned on, the IC 50 registers a count every time the sensor 60 is triggered. The sensor 60 is triggered when the receiver 60*a* registers a disruption in light. The user may view feedback on whatever game function was selected by mode input 54, simply by depressing the display input 56 and looking at the display 70.

Figure 4:
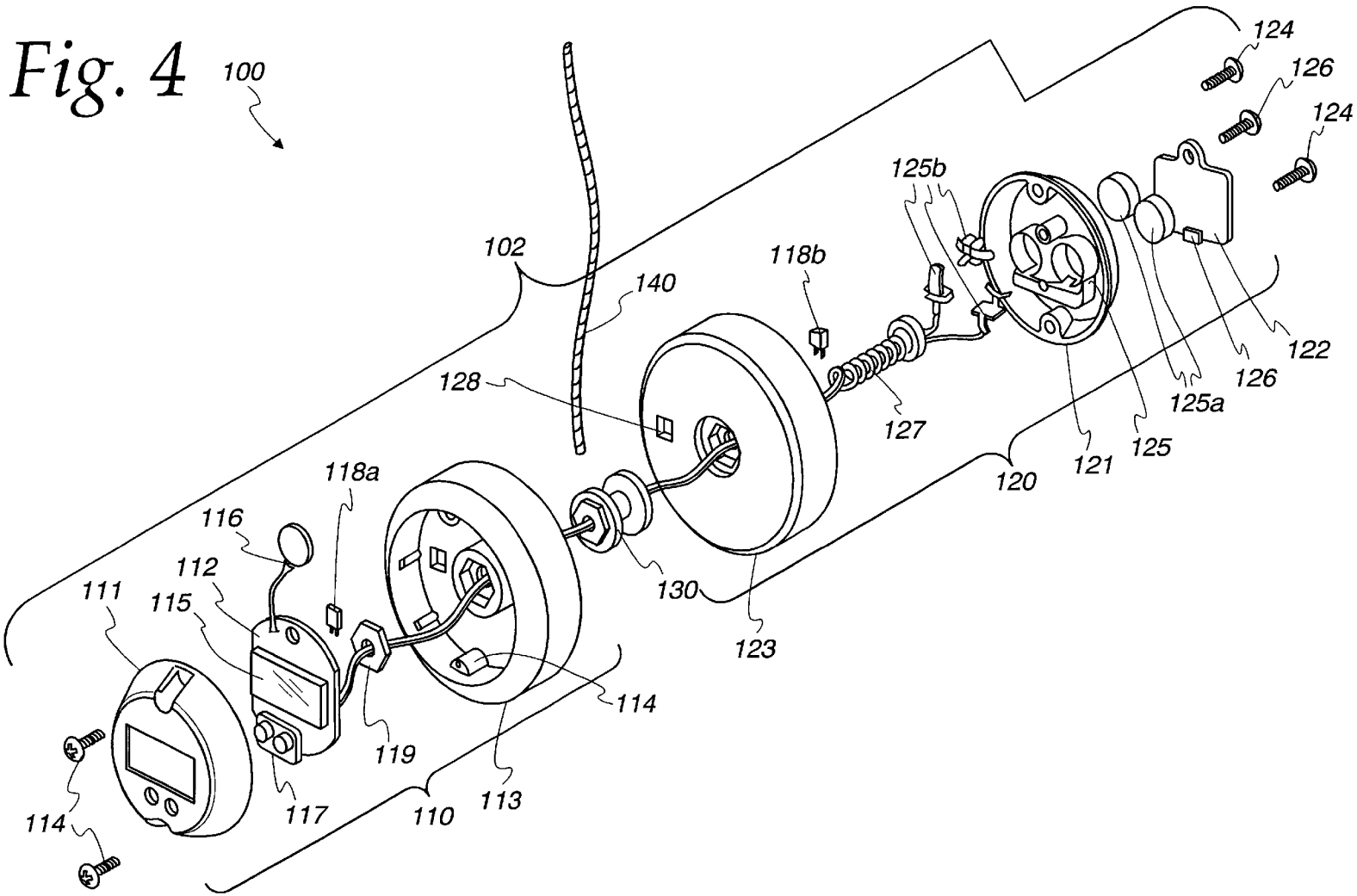
FIG. 4 is a fragmentary view of an alternative embodiment of a hand-held electronic game according to the invention.

FIG. 4 shows a fragmentary view of an alternate embodiment of a hand-held electronic game 10 according to the invention. In this alternative embodiment, the game 100 consists of a body 102 made up of a left portion 110, a right portion 120, and a shaft 130 connecting the two portions 110 and 120. The left portion 110 contains a face plate 111, a circuit board 112, and a shell 113. The face plate 111 is connected to the circuit board 112 and the shell 113 by fastener, or fasteners, 114. The fastener, or fasteners, 114 are preferably screws or bolts capable of releasably attaching the face plate 111 to the shell 113, but other fasteners may be used including those that fixedly attach the face plate 111 to the shell 113 (i.e., rivets or glue). In this embodiment, the fasteners 114 are screw type fasteners. The circuit board contains a display 115, a piezo speaker 116, one or more user inputs 117, and an optical sensor 118. The display is preferably a liquid-crystal display (LCD), but could be any type of display including a dot matrix display. It is preferred that the user input 117 be a set of push buttons, but other types of inputs may be used, such as touch pads. Under this embodiment, the optical sensor 118 consists of an infra-red light emitting diode (IRLED) 118*a* and a photo diode 118*b*, but any sensor alternate will do (e.g., an inertia sensor). The shell 113 incorporates a fastener 119 that will connect the left portion 110, right portion 120, and shaft 130 together. The fastener 119 is preferably a screw or nut capable of releasably attaching the left portion 110, right portion 120, and shaft 130, but other fasteners may be used including those that fixedly attach these components (i.e., rivets or glue).

The right portion 120 contains a rear plate 121, a battery cover 122, and a shell 123. The rear plate 121 is connected to the shell 123 by a fastener, or fasteners, 124. The fastener, or fasteners, 124 are preferably screws or bolts capable of releasably attaching the rear plate 121 to the battery cover 122, but other fasteners may be used including those that fixedly attach the rear plate 121 to the battery cover 122 (i.e., rivets or glue). The rear plate 121 incorporates a battery compartment 125, batteries 125*a*, and battery contacts 125*b*. The battery compartment is enclosed by a battery cover 122. The battery cover 122 is connected to the rear plate 121 by a fastener, or fasteners, 126. The fastener, or fasteners, 126 are preferably screws or bolts capable of releasably attaching the battery cover 122 to the rear plate 121, but other fasteners may be used including those that fixedly attach the battery cover 122 to the rear plate 121 (i.e., rivets or glue). The shell 123 incorporates a fastener 127 to be connected to the fastener 119 in order to keep the left portion 110, right portion 120, and shaft 130 together, and an opening 128 for the optical sensor 118*b*. The fastener 127 is preferably a screw or bolt capable of releasably attaching the left portion 110, right portion 120, and shaft 130, but other fasteners may be used including those that fixedly attach these components (i.e., rivets or glue).

In the preferred embodiment, the body 102 rotates up and down a string 140 attached to said shaft 130. In alternate embodiments, said string 140 could be any synthetic or fibrous material capable of coiling around said shaft 130. When the body 102 spins, the string 140 interrupts the light from the IRLED 118*a* to the photo diode 118*b* as it passes between them. This triggers the electronic circuitry and the controller (not shown) registers each time the string passes between IRLED 118*a* and photo diode 118*b*. The user can view feedback (e.g., distance, time, speed, count, etc.), on his or her performance during or after the game by depressing one or more user input 117.

An additional game function elected by depressing user input 117 might consist of the ability to care for, and receive feedback on the characteristics of, a virtual pet, or other character. During or after play with a yo-yo or top, for example, the user could interact with a virtual pet such as a dog, cat, monkey, alien, robot, dinosaur, or interact with other characters such as a person, clown, or fictitious creature. Moreover, the user may interact with multiple virtual pets, characters, or a combination thereof.

Interaction of this type may include the ability to name and care for the characteristics of the pet or character. Such characteristics may include happiness, health, hygiene, life, and feeding or play schedule. For instance, the act of playing the game may be required to feed the pet/character or keep it alive. When a particular pet or character dies, the game may store its name and properties. In addition, numerous play activities may be provided with the game. For example, the user may be able to play catch with a ball, catch a frisbee, or pull on a toy. Similarly, the user may be required to perform specified tricks (i.e., walk the dog, around the world, etc.), in order to satisfy the pet/character's craving for play or to score higher. When the user interacts with the pet or character, he or she can earn points for happiness of the pet or character or points for training the pet or character a particular trick. For instance, the user could earn points or increase the health of a pet/character simply by playing the game (i.e., tossing the yo-yo, or turning the top).

A further game function elected by depressing user input 117 might consist of the ability to play additional games from memory (not shown) (e.g., video games). After playing the game in a mechanical way (i.e., yo-yoing, spinning the top, etc.), the user may opt to play a different electronic game offered by the same device (i.e. a video game stored in memory). Such a game could be a role-playing game where the user operates the user input 25 to control a character. One input may be used to control direction (e.g., up, down, left, right, etc.), another may be used to control action (e.g., punch, kick, use weapon, etc.). Other game functions available to the user by depressing user input 117 might be the ability to turn on/off the hand-held electronic game or reset it.

Figure 5:
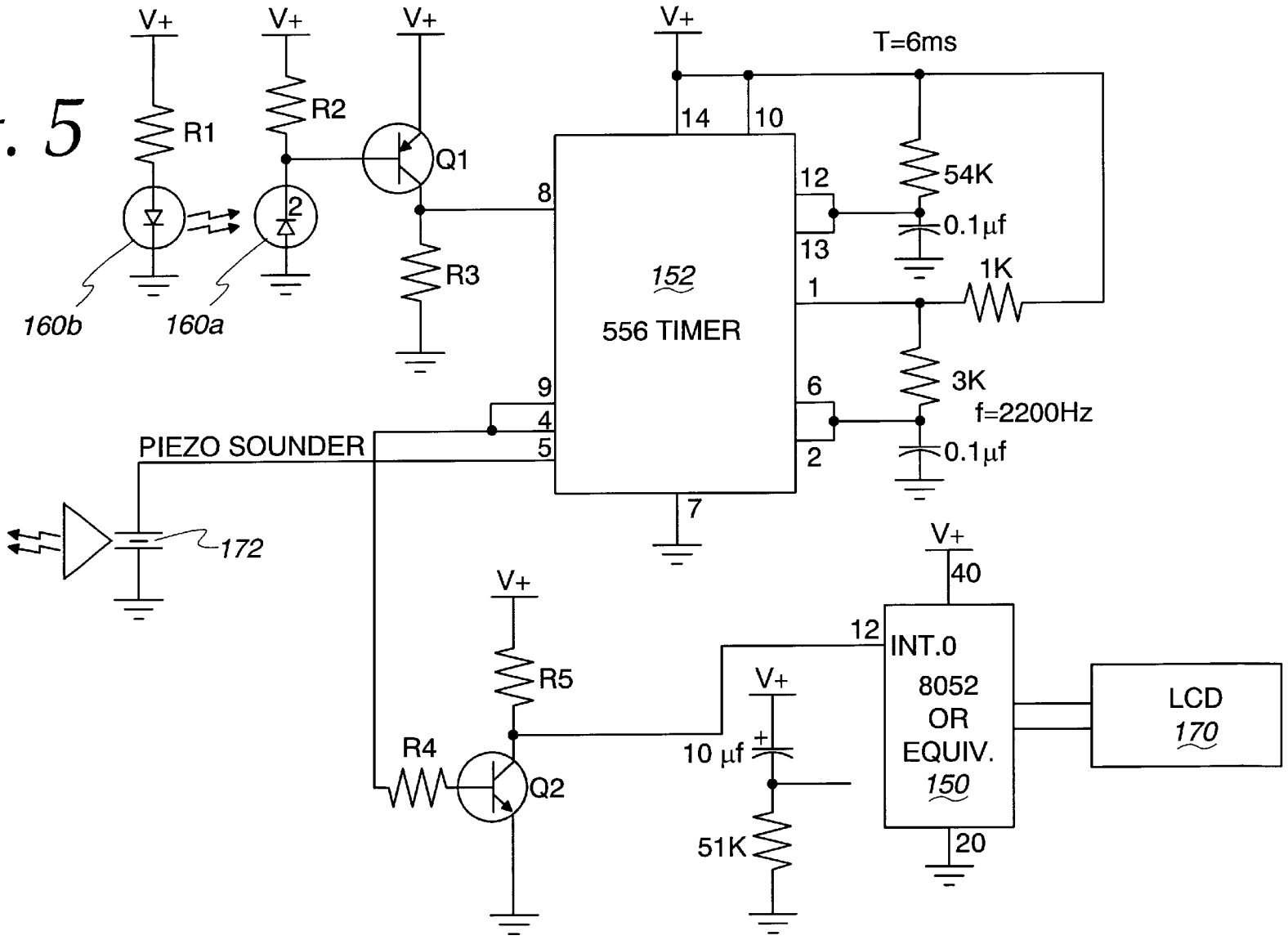
FIG. 5 is a schematic of alternative circuitry for a hand-held electronic game apparatus according to the invention.

FIG. 5 is a schematic diagram of alternate circuitry for a hand-held electronic game apparatus according to the invention. In this embodiment, the hand-held electronic game utilizes integrated circuit chips (ICs) 150 and 152 to perform many operations, but it should be apparent to those skilled in the art that other ICs could be used, and that none of these operations require use of an IC. When the game is turned on, ICs 150 and 152 register counts every time the sensor 160 is triggered. The sensor 160 is triggered when the photo diode 160a registers a disruption in light sent by the IRLED 160*b*. IC 152 registers the triggering of the sensor 160 and outputs a signal to the speaker 172. In this embodiment, the speaker is a piezo buzzer, but other speakers may be used. IC 152 also outputs a signal to IC 152 which registers the triggering of the sensor 160. IC 152 calculates and displays the desired feedback or game function on the display 170.

Figure 6:
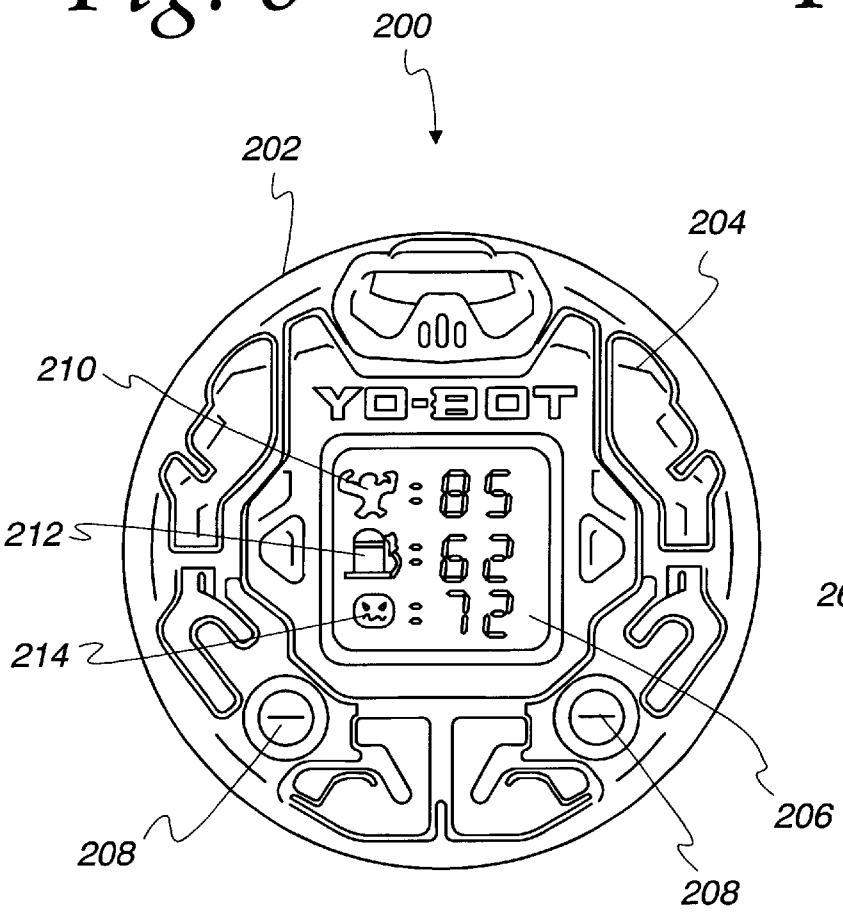
FIG. 6 is a front view of an alternative embodiment casing for a hand-held electronic game according to the invention with an exemplary view of a virtual pet/character display.

FIG. 6 is a front view of an alternative embodiment casing for a hand-held electronic game according to the invention with an exemplary view of a virtual pet/character display. The body 202 of the hand-held electronic game 200 incorporates a character or feature 204, a display 206, and one or more user input 208. The character 204 may cover the entire portion of the body 202, or may cover only a portion of the body 202 (e.g., only the face plate or only the shell if such an embodiment exists). In this embodiment, the character 204 selected is related to the game function provided by the hand-held electronic game 200 (i.e., a robot character was selected because of the relationship to the robot virtual pet/character game function available on the hand-held electronic game 200). Other examples of this type of relationship include a bear character selected for a hand-held electronic game offering a bear virtual pet/character game function, or a pirate character selected for a hand-held electronic game offering a pirate virtual pet/character game function. In alternative embodiments the character 204 selected may have little or nothing to do with the functions available on the hand-held electronic game 200 (e.g., the character or feature may be a flower even though no function available on the hand-held electronic game relates to a flower).

The body 202 incorporates a display 206 and one or more user input 208. In this embodiment, the display 206 is preferably an LCD display. The LCD display 206 shows an exemplary view of a virtual pet/character game function. An exemplary display of the virtual pet/character's strength 210 is shown. A user is able to determine how strong the virtual pet/character is by looking at the display 206. The user can alter the level of the virtual pet/character's strength by doing or not doing a required activity (e.g., by playing with the hand-held electronic game 200, the virtual pet/character's strength may go up; likewise, by not feeding the virtual pet/character when required, the virtual pet/character's strength may go down). In alternate embodiments, a user may access the virtual pet/character's life level, skill level, etc.

An exemplary display of the virtual pet/character's fuel level 212 is shown. A user is able to determine how much fuel the virtual pet/character has or needs by looking at the display 210 and/or depressing one or more user inputs 208. The user can alter the level of the virtual pet/character's fuel by doing or not doing a required activity (e.g., by tossing the hand-held electronic game 200 fast, the virtual pet/character's fuel level may go up; likewise, by not selecting the option to fuel-up the virtual pet/character when required, the virtual pet/character's fuel level may go down). In alternate embodiments, a user may access the virtual pet/character's health level, hunger level, etc.

An exemplary display of the virtual pet/character's happiness level 214 is shown. A user is able to determine how much happiness the virtual pet/character has or needs by looking at the display 210 and/or depressing one or more user inputs 208. The user can alter the level of the virtual pet/character's happiness by doing or not doing a required activity (e.g., by playing the hand-held electronic game 200, the virtual pet/character's happiness level may go up; likewise, by not complying with the needs of the virtual pet/character at a particular time, the happiness level may go down). In alternate embodiments, a user may access the virtual pet/character's IQ level, obedience level, etc.

Figure 7:
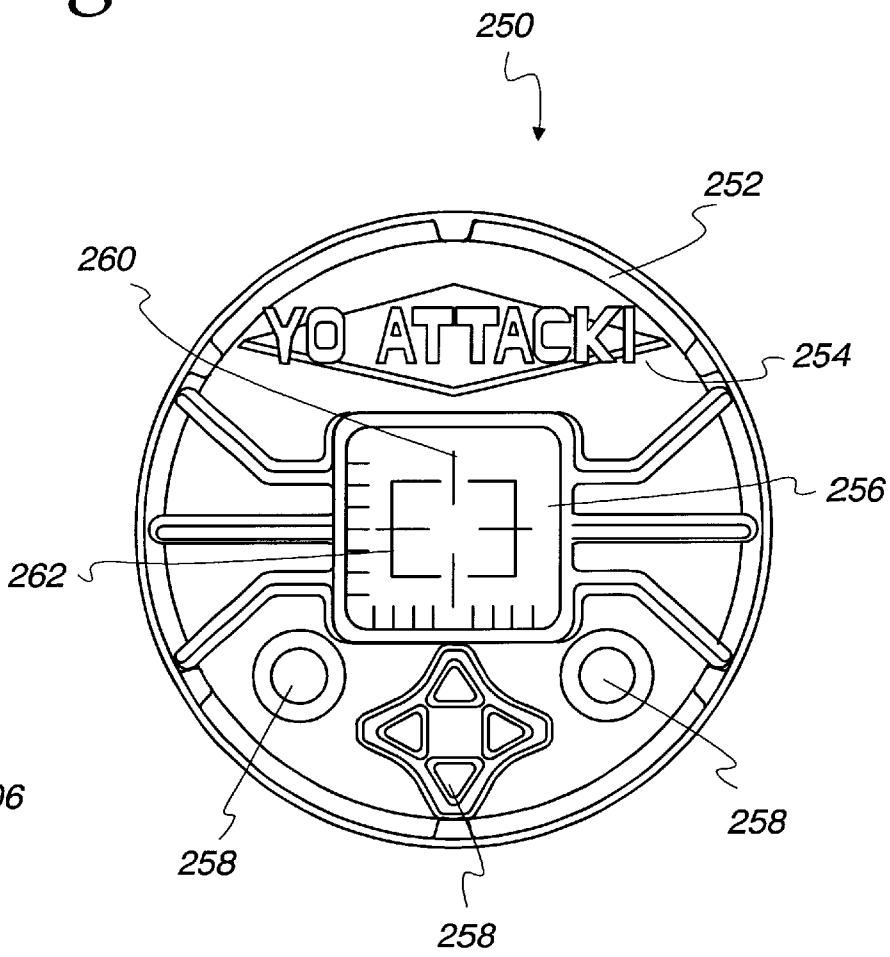
FIG. 7 is a front view of an alternative embodiment casing for a hand-held electronic game according to the invention with an exemplary view of an additional game stored in memory display.

FIG. 7 is a front view of an alternative embodiment casing for a hand-held electronic game according to the invention with an exemplary view of an additional game stored in memory display. The body 252 of the hand-held electronic game 250 incorporates a character or feature 254, a display 256, and one or more user input 258. The character or feature 254 may cover the entire portion of the body 252, or may cover only a portion of the body (e.g., only the face plate or only the shell if such an embodiment exists). In this embodiment, the character or feature 254 selected is related to the game stored in memory (or video game), game function provided by the hand-held electronic game 250 (i.e., a "yo attack" design because of the relationship to the action/fighting video game function available on the hand-held electronic game 250). Other examples of this type of relationship include a tank design selected for a hand-held electronic game offering an action video game function involving a tank, or a car design selected for a hand-held electronic game offering an action video game function involving a car. In alternative embodiments the character or feature 254 selected may have little or nothing to do with the functions available on the hand-held electronic game 250 (e.g., the character or feature may be a flower even though no function available on the hand-held electronic game relates to a flower).

The body 252 incorporates a display 256 and one or more user input 258. In this embodiment, the display 256 is preferably an LCD display. The LCD display 256 shows an exemplary view of an action video game function display. In this embodiment, cross hairs 260 and other marks 262 define a line of sight in which the user is to position a target before attacking it. The user can attack by depressing one or more user inputs 258. In alternate embodiments, the display 256 may show a pair of fists, hands holding weapons, or merely display the video game graphics. In this embodiment, the user inputs 258 allow the user to maneuver up, down, side-to-side, attack, and select. However, in alternate embodiments only one user input may be required and/or the display may perform the function of the user input (i.e., a touch screen display).

Thus it is apparent that there has been provided, in accordance with the invention, a hand-held electronic game 10 that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An electronic game apparatus comprising: a rotatable body rotating about an axis of rotation; a display coupled to said body for displaying graphics and textual images; a controller coupled to said body for receiving and processing data, and for outputting data, graphics, and textual images to said display; memory coupled to, and accessible by, said controller for storing information relating to said electronic game apparatus, said information comprising data related to the use of said electronic game apparatus and for generating, identifying and controlling a plurality of separate game functions; a sensor coupled to said controller for receiving said information related to the use of said electronic game apparatus and for transmitting said information to said memory for access said controller; and one or more user inputs for inputting commands to said controller of said electronic game apparatus, said controller processing and outputting said data, graphics, and textual images in accordance with and in response to said user inputs.

2. The electronic game apparatus of claim 1, wherein said separate game functions comprise an entity with which a user interacts to control the entity's characteristics.

3. The electronic game apparatus of claim 1, wherein said separate game functions comprise calculating the speed of said rotatable body.

4. The electronic game apparatus of claim 1, wherein said separate game functions comprise the playing of a game stored in said memory.

5. An electronic game apparatus comprising:

a yo-yo having a first and second side connected by a shaft, said yo-yo rotating up and down a string attached to said shaft; a display coupled to one of said sides of said yo-yo for displaying graphics and textual images; a controller coupled to one of said sides of said yo-yo for receiving, and processing data, and for outputting data, graphics, and textual images to said display;

memory coupled to, and accessible by, said controller for storing information relating to said electronic game, said information comprising data related to the use of said yo-yo and for generating, identifying, and controlling a plurality of separate game functions; a sensor coupled to said controller for receiving information related to the use of said yo-yo and for transmitting said information to said controller; and one or more user inputs for inputting commands to said controller of said electronic game apparatus, said controller processing and outputting said data, graphics, and textual images in accordance "with and in response to said user inputs.

6. The electronic game apparatus of claim 5, wherein said separate game functions comprise an entity with which a user interacts to control the entity's characteristics.

7. The electronic game apparatus of claim 5, wherein said separate game functions comprise calculating the speed of said rotatable body.

8. The electronic game apparatus of claim 5, wherein said separate game functions comprise the playing of a game stored in said memory.

9. A method for displaying information related to the operation of an electronic game comprising the steps of: providing a body capable of rotating about an axis; providing electronic circuitry having a sensor, controller, display, and memory interconnected; sensing information relating to use of said body as a function of rotational movement of said body about said axis; transmitting said information gathered by said sensor to said memory for use by said controller selectively processing said information by said controller to generate, identify and control a plurality of separate functions in response to user inputs; and displaying information on said display.

10. The method of claim 9, wherein said information comprises an entity with which a user interacts to control the entity's characteristics.

11. The method of claim 9, wherein said information comprises calculating the speed of said rotatable body.

12. The method of claim 9, wherein said electronic game comprises providing a game stored in said memory to be played by a user.

13. An electronic game apparatus comprising: a rotatable body rotating about an axis of rotation; a display coupled to said body for displaying graphics and textual images; a controller coupled to said body for receiving, processing, and outputting data, graphics, and textual images to said display; memory coupled to, and accessible by, said controller for storing information relating to said electronic game apparatus, said information of said memory comprising code for generating, identifying, and controlling a plurality of separate game functions, said separate game functions comprising calculating the distance said rotatable body has traveled; a sensor coupled to said controller for receiving information related to the use of said electronic game apparatus and for transmitting said information to said controller; and one or more user inputs for inputting commands to said electronic game apparatus.

14. An electronic game apparatus comprising: a rotatable body rotating about an axis of rotation; a display coupled to said body for displaying graphics and textual images; a controller coupled to said body for receiving, processing, and outputting data, graphics, and textual images to said display; memory coupled to, and accessible by, said controller for storing information relating to said electronic game apparatus, said information of said memory comprising code for generating, identifying, and controlling a plurality of separate game functions, said separate game functions comprising calculating the time of usage of said rotatable body a sensor coupled to said controller for receiving information related to the use of said electronic game apparatus and for transmitting said information to said controller; and one or more user input putting commands to said electronic game apparatus.

15. An electronic game apparatus comprising: a rotatable body rotating about an axis of rotation; a display coupled to said body for displaying graphics and textual images; a controller coupled to said body for receiving, processing, and outputting data, graphics, and textual images to said display; memory coupled to, and accessible by, said controller for storing information relating to said electronic game apparatus, said information of said memory comprising code for generating, identifying, and controlling a plurality of separate game functions, said separate game functions comprising counting the number of times said rotational body has been operated; a sensor coupled to said controller for receiving information related to the use of said electronic game apparatus and for transmitting said information to said controller; and one or more user inputs for inputting commands to said electronic game apparatus.

16. An electronic game apparatus comprising: a yo-yo having a first and second side connected by a shaft, said yo-yo rotating up and down a string attached to said shaft; a display coupled to one of said sides of said yo-yo for displaying graphics and textual images; a controller coupled to one of said sides of said yo-yo for receiving, processing, and outputting data, graphics, and textual images to said display; memory coupled to, and accessible by, said controller for storing information relating to said electronic game, said information of said memory comprising code for generating, identifying, and controlling a plurality of separate game functions, said separate game functions comprising calculating the distance said rotatable body has traveled; a sensor coupled to said controller for receiving information related to the use of said yo-yo and for transmitting said information to said controller; and one or more user inputs for inputting commands to said electronic game apparatus.

17. An electronic game apparatus comprising: a yo-yo having a first and second side connected by a shaft, said yo-yo rotating up and down a string attached to said shaft; a display coupled to one of said sides of said yo-yo for displaying graphics and textual images; a controller coupled to one of said sides of said yo-yo for receiving processing, and outputting data, graphics, and textual images to said display; memory coupled to, and accessible by, said controller for storing information relating to said electronic game, said information of said memory comprising code for generating, identifying, and controlling a plurality of separate game functions, said separate game functions comprising calculating the time of usage of said rotatable body; a sensor coupled to said controller for receiving information related to the use of said yo-yo and for transmitting said information to said controller; and one or more user inputs for inputting commands to said electronic game apparatus.

18. An electronic game apparatus comprising: a yo-yo having a first and second side connected by a shaft, said yo-yo rotating up and down a string attached to said shaft; a display coupled to one of said sides of said yo-yo for displaying graphics and textual images; a controller coupled to one of said sides of said yo-yo for receiving, processing, and outputting data, graphics, and textual images to said display; memory coupled to, and accessible by, said controller for storing information relating to said electronic game, said information of said memory comprising code for generating, identifying, and controlling a plurality or of separate game functions, said separate game functions comprising calculating a total number of times said yo-yo has been operated; separate game functions comprise calculating a total number of times said yo-yo has been operated a sensor coupled to said controller for receiving information related to the use of said yo-yo and for transmitting said information to said controller; and one or more user inputs for inputting commands to said electronic game apparatus.

19. A method for displaying information related to the operation of an electronic game comprising the steps of: providing a body capable of rotating about an axis; providing electronic circuitry having a sensor, controller, display, and memory interconnected; sensing information relating to rotational movement of said body about said axis, said information comprising calculating the distance said rotatable body has traveled; transmitting said information gathered by said sensor to said controller; processing said information by said controller; and displaying said information on said display.

20. A method for displaying information related to the operation of an electronic game comprising the steps of: providing a body capable of rotating about an axis; providing electronic circuitry having a sensor, controller, display, and memory interconnected; sensing information relating to rotational movement of said body about said axis, said information comprising calculating the time of usage of said rotatable body; transmitting said information gathered by said sensor to said controller; processing said information by said controller; and displaying said information on said display.

21. A method for displaying information related to the operation of an electronic game comprising the steps of: providing a body capable of rotating about an axis; providing electronic circuitry having a sensor, controller, display, and memory interconnected; sensing information relating to rotational movement of said body about said axis, said information comprising calculating a total number of times said yo-yo has been operated; transmitting said information gathered by said sensor to said controller; processing said information by said controller; and displaying said information on said display.

* * * * *